US010373748B2

(12) United States Patent
Pagano et al.

(10) Patent No.: US 10,373,748 B2
(45) Date of Patent: Aug. 6, 2019

(54) TEMPERATURE-STABLE SOFT-MAGNETIC POWDER

(71) Applicant: BASF SE, Ludwigshafen (DE)

(72) Inventors: Sandro Pagano, Mannheim (DE); Jae Hyung Hwang, Viernheim (DE); Ralf Liebscher, Ottersheim (DE); Frank Prechtl, Frankfurt (DE); Oliver Koch, Wachenheim (DE); Otto Watzenberger, Mannheim (DE); Volker Klock, Ludwigshafen (DE)

(73) Assignee: BASF SE (DE)

( * ) Notice: Subject to any disclaimer, the term of this patent is extended or adjusted under 35 U.S.C. 154(b) by 716 days.

(21) Appl. No.: 15/034,039

(22) PCT Filed: Nov. 4, 2014

(86) PCT No.: PCT/EP2014/073719

§ 371 (c)(1),
(2) Date: May 3, 2016

(87) PCT Pub. No.: WO2015/067608

PCT Pub. Date: May 14, 2015

(65) Prior Publication Data

US 2016/0276078 A1 Sep. 22, 2016

(30) Foreign Application Priority Data

Nov. 6, 2013 (EP) ..... 13191747

(51) Int. Cl.

| | |
|---|---|
| ***H01F 1/36*** | (2006.01) |
| ***H01F 1/20*** | (2006.01) |
| ***H01F 1/26*** | (2006.01) |
| ***C23C 30/00*** | (2006.01) |
| ***H01F 3/08*** | (2006.01) |
| ***H01F 41/02*** | (2006.01) |
| ***B22F 1/02*** | (2006.01) |

(52) U.S. Cl.

CPC ..... *H01F 1/20* (2013.01); *B22F 1/02* (2013.01); *C23C 30/00* (2013.01); *H01F 1/26* (2013.01); *H01F 1/36* (2013.01); *H01F 3/08* (2013.01); *H01F 41/0246* (2013.01)

(58) Field of Classification Search

CPC ..... H01F 1/20; H01F 1/24; H01F 1/26; H01F 1/36

See application file for complete search history.

(56) References Cited

U.S. PATENT DOCUMENTS

| | | | |
|---|---|---|---|
| 4,652,305 | A | 3/1987 | Ebenhoech et al. |
| 5,085,690 | A | 2/1992 | Ebenhoech et al. |
| 5,989,304 | A | 11/1999 | Ozaki et al. |
| 8,211,327 | B2 | 7/2012 | Nakamura et al. |
| 2008/0117008 | A1 | 5/2008 | Komuro et al. |

FOREIGN PATENT DOCUMENTS

| | | | |
|---|---|---|---|
| DE | 3 428 121 | A1 | 2/1986 |
| DE | 3 940 347 | A1 | 6/1991 |
| DE | 19807634 | A1 | 11/1998 |
| JP | 2001 192 842 | A | 7/2001 |
| JP | 2010 251 437 | A | 11/2010 |
| RU | 2299786 | C2 | 5/2007 |
| RU | 2367045 | C2 | 9/2009 |
| WO | WO-98/005454 | A1 | 2/1998 |

OTHER PUBLICATIONS

International Preliminary Examination Report for PCT/EP2014/073719 dated Nov. 10, 2015.
International Search Report for PCT/EP2014/073719 dated Jan. 8, 2015.

*Primary Examiner* — Matthew E. Hoban
(74) *Attorney, Agent, or Firm* — Drinker Biddle & Reath LLP

(57) ABSTRACT

The invention relates to a soft-magnetic powder coated with a silicon based coating, wherein the silicon based coating comprises at least one of the following fluorine containing compositions:

a) a fluorine containing composition of formula (I)

$$Si_{1-0,25a}M1_aO_{2-0,5b}F_b \quad (I)$$

wherein a is in the range of 0.015 to 0.52, b is in the range of 0.015 to 0.52,

M1 is H, K, Rb, Cs or $NR^1_4$, wherein each $R^1$ is independently selected from the group consisting of H, $C_{1-6}$ alkyl, phenyl and benzyl; or b) a fluorine containing composition of formula (II)

$$Si_{1-0,75c}M2_cO_{2-0,5d}F_d \quad (II)$$

wherein c is in the range of 0.005 to 0.17, d is in the range of 0.015 to 0.52, M2 is B or Al; or c) a fluorine containing composition of formula (III)

$$Si_{1-1,25e}P_eO_{2-0,5f}F_f \quad (III)$$

wherein e is in the range of 0.003 to 0.10, f is in the range of 0.015 to 0.52.

The invention further relates to a process of coating the soft-magnetic powder, the use of such soft-magnetic powder and an electronic component including such soft-magnetic powder.

16 Claims, No Drawings

TEMPERATURE-STABLE SOFT-MAGNETIC POWDER

CROSS-REFERENCE TO RELATED APPLICATIONS

This application is a national stage application (under 35 U.S.C. § 371) of PCT/2014/073719, filed Nov. 4, 2014, which claims benefit of European Application No. 13191747.8, filed Nov. 6, 2013, both of which are incorporated herein by reference in their entirety.

The invention relates to a soft-magnetic powder and a process of coating the soft-magnetic powder. The invention further relates to the use of such soft-magnetic powder and an electronic component including such soft-magnetic powder.

A popular application of soft-magnetic powder includes magnetic core components, which serve as piece of magnetic material with a high permeability used to confine and guide magnetic fields in electrical, electromechanical and magnetic devices such as electromagnets, transformers, electric motors, inductors and magnetic assemblies. These components are usually produced in different shapes and sizes by molding soft-magnetic powder in a die under high pressure.

In electronic applications, particularly in alternating current (AC) applications, the two key characteristics of the magnetic core component are the magnetic permeability and the core loss characteristic. In this context, the magnetic permeability of a material provides an indication of its ability to become magnetized or its ability to carry a magnetic flux. Permeability is defined as the ratio of the induced magnetic flux to the magnetizing force or field intensity. When a magnetic material is exposed to a rapidly varying field, the total energy of the core is reduced by the occurrence of hysteresis losses and/or eddy current losses. The hysteresis loss is caused by the necessary expenditure of energy to overcome the retained magnetic forces within the core component. The eddy current loss is caused by the production of electric currents in the core component due to the changing flux caused by AC conditions and basically results in a resistive loss.

Generally, devices for high frequency applications are sensitive to core losses and in order to reduce losses due to eddy currents good insulation of the soft-magnetic powder particles is desired. The simplest way of achieving this is thickening an insulating layer for each particle. However, the thicker the insulation layer is, the lower the core density of soft-magnetic particles gets and the magnetic flux density decreases. Thus, in order to manufacture a soft-magnetic powder core having optimal key characteristics, it is necessary to increase the resistivity and the density of the core simultaneously.

Another aspect of the insulation concerns temperature performance and durability of the insulation layer. Particularly high temperatures can result in degradation of the insulation layer by developing cracks which promote eddy current losses. Thus temperature stability is a further requirement to manufacture a soft-magnetic powder core with optimal characteristics. Ideally particles would be covered with a thin insulating layer providing a high resistivity and a high density with a stable temperature performance.

In order to avoid degradation of the insulation layer due to temperature effects different approaches exist. JP 2010 251 437 A discloses a coated magnetic powder, wherein the coating includes magnesium fluoride ($MgF_2$). In particular iron powder is coated with a film containing magnesium fluoride and lubricant, wherein the lubricant is sandwiched between magnesium fluoride layers.

US 2008/0117008 A1 relates to a magnet comprising magnetic powder. The magnetic powder is coated with an oxide binder and an insulating film, wherein the insulating film is present between the magnetic powder and the oxide binder. The oxide binder includes a glassy oxide like silicon dioxide. The insulating film includes a fluoride of rare earth.

WO 98/005454 A1 relates to an iron-based powder composition for powder metallurgy with enhanced flowability and compactibility properties. The method for treating the iron-based powder includes mixing powders, such as organoalkoxysilicon and organosilicon, with a lubricant alloy and silicon oil. The mixture is coated with a fluorine system as surface processing agent.

Other approaches use fluorine and carbon containing compositions to increase repellant properties. JP 2001 192 842 A describes a metallic material coated with a treating agent for metals composed of a metallic alkoxide containing solution. The coating film of iron powder contains $SiO_2$ and a carbon component including fluorinated compounds (e.g. fluoroalkyl carbon) in order to increase repellant properties.

Known processes for forming insulating layers on magnetic particles typically tackle one of the key characteristics, i.e. the density or the resistivity. However, if the particles coated with the insulation layer are subject to temperatures over 120° C., preferably over 150° C., for a couple of hours the insulation layer can develop cracks, which lead to higher eddy currents and lower resistivity values. Hence, there is still a need in the art to further improve the insulation layer of soft-magnetic powder in order to reach optimal results for magnetic core components prepared from such powders.

Therefore, it is an object of the invention to provide a coated soft-magnetic powder and a corresponding process for coating a soft-magnetic powder that facilitates to achieve good temperature stability, high resistivity and high permeability when utilized in magnetic core components. Furthermore, it is an object of the invention to provide a process which allows to achieve aforementioned goals in a simple, cost-effective and uncomplicated manner. Another object of the invention is to provide electronics components including soft-magnetic powder with good temperature stability, high resistivity and high permeability.

These objects are achieved by a soft-magnetic powder coated with a silicon based coating, wherein the silicon based coating comprises at least one of the following fluorine containing compositions:

a) a fluorine containing composition of formula (I)

$$Si_{1-0,25a}M1_aO_{2-0,5b}F_b \quad (I)$$

wherein a is in the range of 0.015 to 0.52, b is in the range of 0.015 to 0.52,

M1 is H, K, Rb, Cs or $NR^1_4$, wherein each $R^1$ is independently selected from the group consisting of H, $C_{1-6}$ alkyl, phenyl and benzyl;

b) a fluorine containing composition of formula (II)

$$Si_{1-0,75c}M2_cO_{2-0,5d}F_d \quad (II)$$

wherein c is in the range of 0.005 to 0.17, d is in the range of 0.015 to 0.52,

M2 is B or Al;

or c) a fluorine containing composition of formula (III)

$$Si_{1-1,25e}P_eO_{2-0,5f}F_f \quad (III)$$

wherein e is in the range of 0.003 to 0.10, f is in the range of 0.015 to 0.52.

The invention further relates to a process for coating a soft-magnetic powder, wherein the soft-magnetic powder is mixed with a silicon based solution containing a soluble fluorination agent. The invention further relates to a soft-magnetic powder obtained by the process for coating or a soft-magnetic powder coated according to the process. The invention also concerns the use of the coated soft-magnetic powder for manufacturing electronic components, in particular magnetic core components, as well as an electronic component, in particular a magnetic core componeat, including the coated soft-magnetic powder.

The following description concerns the coated soft-magnetic powder as well as the process for coating the soft-magnetic powder proposed by the invention. In particular, embodiments of the soft-magnetic powder, the fluorine containing composition and the soluble fluorination agent apply to the coated soft-magnetic powder, to the process for coating the soft-magnetic powder and the soft-magnetic obtained by the process alike.

The invention provides a process for coating soft-magnetic powder and the corresponding coated powder which is optimally suitable for manufacturing electronic components. In particular, the soft-magnetic powder coated according to the invention allows to achieve high temperature durability, high resistivity and high permeability when used for manufacture of electronic components, such as magnetic core components. Furthermore, owing to the simple and uncomplicated manner of the proposed method, a high batch-to-batch consistency can be achieved, which again allows for reliable production of electronic components. Overall, the soft-magnetic powder coated according to the invention facilitates to prepare electronic components with unique electromagnetic performance characteristics and high temperature durability, particularly for temperatures >120° C. and preferred >150° C.

In the context of the present invention, the individual components, e. g. Si, O, F, of the fluorine containing compositions may be evenly distributed throughout the silicon based coating. In this case, the fluorine containing compositions as specified herein indicate the composition of the homogeneous silicon based coating. Alternatively, the silicon based coating may be inhomogeneous. In such a case the individual components of the fluorine containing compositions as specified herein indicate a mean of the composition of the silicone based coating across the coating. For example, the silicon based coating may contain one or more layers of silicon dioxide ($SiO_2$) and one or more layers further containing a fluorine component. The fluorine containing compositions as specified herein then indicate a mean composition of the layered or inhomogeneous silicon based coating.

In the context of the present invention specifications in % by weight (wt.-%) refer to the fraction of the total weight of soft-magnetic powder unless otherwise specified. For instance, the solution for coating the soft-magnetic powder includes a soluble fluorination agent as specified above and optionally further components such as a solvent. Here wt.-% refers to the fraction of total weight of soft-magnetic powder to be treated with the solution, unless explicitly stated otherwise. Hence indications in wt.-% are based on the total weight of soft-magnetic powder excluding other components e.g. from the solution.

The soft-magnetic powder of the present invention includes a plurality of particles composed of a soft-magnetic material. Such powders comprise particles with a mean size between 0.5 and 250 μm, preferably between 2 and 150 μm, more preferably between 2 and 10 μm. These particles may vary in shape. In respect of the shape, numerous variants known to the person skilled in the art are possible. The shape of the powder particles may, for example, be needle-shaped, cylindrical, plate-shaped, teardrop-shaped, flattened or spherical. Soft-magnetic particles with various particle shapes are commercially available. Preferred is a spherical shape as such particles can be coated more easily, which in fact results in a more effective insulation against electrical current.

As soft-magnetic material an elemental metal, an alloy or a mixture of one or more elemental metal(s) with one or more alloy(s) may be employed. Typical elemental metals comprise Fe, Co and Ni. Alloys may include Fe-based alloys, such as Fe—Si alloy, Fe—Si—Cr alloy, Fe—Si—Ni—Cr alloy, Fe—Al alloy, Fe—N alloy, Fe—Ni alloy, Fe—C alloy, Fe—B alloy, Fe—Co alloy, Fe—P alloy, Fe—Ni—Co alloy, Fe—Cr alloy, Fe—Mn alloy, Fe—Al—Si alloy and ferrites, or rare earth based alloy, particularly rare earth Fe-based alloy, such as Nd—Fe—B alloy, Sn—Fe—N alloy or Sm—Co—Fe—Cu—Zr alloy, or Sr-ferrite, or Sm—Co alloy. In a preferred embodiment Fe or Fe-based alloys, such as Fe—Si—Cr, Fe—Si or Fe—Al—Si, serve as soft-magnetic material.

In a particularly preferred embodiment Fe serves as soft-magnetic material and the soft-magnetic powder is a carbonyl iron powder. Carbonyl iron can be obtained according to known processes by thermal decomposition of iron pentacarbonyl in a gas phase, as described, for example, in Ullmann's Encyclopedia of Industrial Chemistry, 5th Edition, Vol. A 14, page 599 or in DE 3 428 121 or in DE 3 940 347, and contains particularly pure metallic iron.

Carbonyl iron powder is a gray, finely divided powder of metallic iron having a low content of secondary constituents and consisting essentially of spherical particles having a mean particle diameter of up to 10 μm. Unreduced carbonyl iron powder, which is preferred in the present context, has an iron content of >97% by weight (here based on the total weight of the powder), a carbon content of <1.5% by weight, a nitrogen content of <1.5% by weight and an oxygen content of <1.5% by weight. Reduced carbonyl iron powder, which is particularly preferred in the process of the present invention, has an iron content of >99.5% by weight (here based on the total weight of the powder), a carbon content of <0.1% by weight, a nitrogen content of <0.01% by weight and an oxygen content of <0.5% by weight. The mean diameter of the powder particles is preferably from 1 to 10 μm and their specific surface area (BET of the powder particles) is preferably from 0.1 to 2.5 $m^2/g$.

The silicon based coating can contain fluorine containing compositions specified by formula (I), compositions specified by formula (II), compositions specified by formula (III) or mixtures thereof. Hence the silicon based coating can contain one or more of the fluorine containing compositions specified by formula (I), one or more of the fluorine containing compositions specified by formula (II), one or more of the fluorine containing compositions specified by formula (III) or mixtures thereof. For instance the silicon based coating can contain a mixture of the fluorine containing compositions specified by formula (I), a mixture of the fluorine containing compositions specified by formula (II) or a mixture of the fluorine containing compositions specified by formula In one embodiment the silicon based coating contains a fluorine containing composition of formula (I)

$$Si_{1-0,25a}M1_aO_{2-0,5b}F_b \quad (I).$$

In the above formula (I) M1 is H, K, Rb, Cs, or $NR^1_4$, wherein each $R^1$ is independently selected from the group consisting of H, $C_{1-6}$ alkyl, phenyl and benzyl; preferably M1 is H, Cs or $NH_4$, particularly preferably Cs or $NH_4$.

In the fluorine containing composition of formula (I) the index a is a number in the range from 0.015 to 0.52, preferably in the range from 0.05 to 0.3 and particularly preferably from 0.1 to 0.25, The index b is a number in the range from 0.015 to 0.52, preferably in the range from 0.05 to 0.3 and particularly preferably from 0.1 to 0.25.

In another embodiment the silicon based coating contains a fluorine containing composition of formula (II)

$$Si_{1-0,75c}M2_cO_{2-0,5d}F_d \quad (II).$$

In the above formula (II) M2 is B or Al, preferably B.

In the fluorine containing composition of formula (II) the index c is a number in the range from 0.005 to 0.17, preferably in the range from 0.015 to 0.1 and particularly preferably from 0.03 to 0.08, The index d is a number in the range from 0.015 to 0.52, preferably in the range from 0.05 to 0.3 and particularly preferably from 0.1 to 0.25, In a further embodiment the silicon based coating contains a fluorine containing composition of formula (III)

$$Si_{1-1,25e}P_eO_{2-0,5f}F_f \quad (III).$$

In the above formula (III) the index e is a number in the range from 0.003 to 0.10, preferably in the range from 0.01 to 0.07 and particularly preferably from 0.02 to 0.06, The index f is a number in the range from 0.015 to 0.52, preferably in the range from 0.05 to 0.3 and particularly preferably from 0.1 to 0.25.

The silicon based coating can comprise between 0.1 to 5 wt.-%, preferred 0.3 to 3 wt.-% and particularly preferred 0.5 wt.-% to 1.5 wt.-% of the at least one fluorine containing composition of formula (I), (II) or (III).

Other than the silicon based coatings specified above the coating could also be based on metal oxides such as aluminium oxide ($Al_2O_3$), magnesium oxide (MgO) or titanium oxide ($TiO_2$, TiO, $Ti_2O_3$). Such coatings can be produced by decomposition of metal alkoxides. Metal alkoxides are typically given by the formula $M4(Or^1)(Or^2).(Or^n)$, wherein M4 is a metal and n the metal's valence. $r^1$, $r^2$, $r^n$ specify organic rests, which can be the same or different. For example r indicates a linear or branch alkyl or a substituted or unsubstituted aryl. Here r indicates a $C_1$-$C_8$ alkyl, such as methyl, ethyl, n-propyl, iso-propyl, n-butyl, iso-butyl, sec.-butyl or tert.-butyl, n-hexyl. 2-ethylhexyl, or a $C_6$-$C_{12}$ aryl, such as phenyl, 2-, 3- or 4-methylphenyl, 2,4,6-trimethylphenyl or naphthyl. Preferred are methyl, ethyl and isopropyl. Further details regarding the process of coating the soft-magnetic powder with the metal oxide, particularly $SiO_2$, are described below.

Furthermore, the fluorine component of the fluorine containing composition can be embedded within a $SiO_2$ matrix and/or bonded to a surface of a $SiO_2$ coating. The fluorine component of the fluorine containing composition can be homogenously or inhomogenously distributed within the $SiO_2$ matrix. For example, the silicon based coating can include one or more layers of a $SiO_2$ coating and one or more layers of a fluorine containing $SiO_2$ coating. Alternatively or additionally, the fluorine component of the fluorine containing composition can be bonded to the surface of the $SiO_2$ coating surrounding the soft-magnetic powder particles, wherein the $SiO_2$ coating can also contain a fluorine component of the fluorine containing composition.

In a further embodiment the silicon based coating has an average thickness of 2 to 100 nm, preferred 5 to 70 nm and particularly preferred 10 to 50 nm. In addition, the ratio of silicon based coating to the soft-magnetic material is not higher than 0.1 and preferably not higher than 0.02. Thus a significant decrease in magnetic flux density of the magnetic core obtained by molding the soft-magnetic powder can be prevented.

A soluble fluorination agent as used in the process for coating the soft-magnetic powder is a fluorination agent having a solubility in ethanol of higher than 10 g/l, preferred higher than 50 g/l and particularly preferred higher than 100 g/l at 20° C. The fluorination agent can alternatively be specified by a very high solubility in water of higher than 100 g/l, preferred higher than 200 g/l and particularly preferred higher than 500 g/l at 20° C.

Preferably the at least one fluorination agent (F) is (A) a salt of formula (IVa) or (IVb)

$$M1F \quad (IVa)$$

$$M2F_3 \quad (IVb)$$

wherein

M1 is H, K, Rb, Cs or $NR^1_4$, wherein each $R^1$ is independently selected from the group consisting of H, $C_{1-6}$ alkyl, phenyl and benzyl; preferably M1 is H, Cs or $NH_4$; particularly preferably Co; and also particularly preferably $NH_4$;

M2 is B or Al, preferably B;

(B) a compound of formula (V)

$$(M3)_2(SiF_6) \quad (V)$$

wherein

M3 is H, Na, K, Rb, Cs or $NR^1_4$, wherein each $R^1$ is independently selected from the group consisting of H, $C_{1-6}$ alkyl, phenyl and benzyl; preferably H or $NH_4$;

(C) a compound of formula (VI)

$$M3PF_6 \quad (VI);$$

wherein

M3 is H, Na, K, Rb, Cs or $NR^1_4$, wherein each $R^1$ is independently selected from the group consisting of H, $C_{1-6}$ alkyl, phenyl and benzyl; preferably H or $NH_4$;

or (D) a Lewis acid-Lewis base adduct, wherein the Lewis acid is $M2F_3$ with

M2 is B or Al, preferably B.

Preferably the at least one Lewis acid-Lewis base adduct (D) is selected from the group consisting of (D1) an adduct of formula (VIIa)

$$L_1 \blacksquare sM2F_3 \quad (VIIa)$$

wherein

M2 is B or Al, preferably B;

$L_1$ is $R^2$—O—$R^3$ or $NR^4R^5R^6$;

s is a number in the range of 0.5 to 1.0, preferably 0.75 to 1.0, particularly preferably 0.8 to 1.0, very particularly preferred 0.9 to 1.0;

$R^2$, $R^3$ are independently from each other selected from the group consisting of H; $C_{1-6}$ alkyl, optionally substituted with halogen or hydroxy; $C_{3-8}$ cycloalkyl, optionally substituted with halogen, hydroxy, $C_{1-6}$ alkyl, $C_{1-6}$ haloalkyl, $C_{1-6}$ hydroxyalkyl, $C_{2-6}$ alkenyl, $C_{1-6}$ alkoxy or $C_{2-6}$ alkenoxy; phenyl, optionally substituted with halogen, $C_{1-6}$ alkyl, $C_{1-6}$ haloalkyl, $C_{1-6}$ hydroxyalkyl, $C_{2-6}$ alkenyl, $C_{1-6}$ alkoxy or $C_{2-6}$ alkenoxy; and benzyl, optionally substituted with halogen, $C_{1-6}$ alkyl, $C_{1-6}$ haloalkyl, $C_{1-6}$ hydroxyalkyl, $C_{2-6}$ alkenyl, $C_{1-6}$ alkoxy or $C_{2-6}$ alkenoxy;

or $R^2$, $R^3$ form, together with the oxygen atom they are bonded to, a 3-8-membered ring;

$R^4$, $R^5$, $R^6$ are independently from each other selected from the group consisting of H; $C_{1-6}$ alkyl, optionally substituted with halogen or hydroxyl; phenyl, optionally substituted with halogen, $C_{1-6}$ alkyl, $C_{1-6}$ haloalkyl, $C_{1-6}$ hydroxyalkyl, $C_{2-6}$ alkenyl, $C_{1-6}$ alkoxy or $C_{2-6}$ alkenoxy; and benzyl, optionally substituted with halogen, $C_{1-6}$ alkyl, $C_{1-6}$ haloalkyl, $C_{1-6}$ hydroxyalkyl, $C_{2-6}$ alkenyl, $C_{1-6}$ alkoxy or $C_{2-6}$ alkenoxy;

or two of $R^4$, $R^5$, $R^6$ form, together with the nitrogen atom they are bonded to, a 3-8-membered ring;

(D2) an adduct of formula (VIIb)

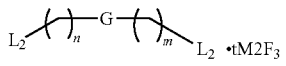

(VIIb)

wherein each M2 is independently B or Al, preferably B;

t is a number in the range of 0.8 to 2, preferably 1.0 to 2.0, particularly preferably 1.5 to 2.0;

G is a single bond or a linking group selected from the group consisting of $C_{1-6}$ alkyl, optionally substituted with halogen, hydroxy, $C_{1-6}$ alkoxy or $C_{2-6}$ alkenoxy; $C_{2-6}$ alkenyl, optionally substituted with halogen, hydroxy, $C_{2-6}$ alkenyl, $C_{1-6}$ alkoxy or $C_{2-6}$ alkenoxy; $C_{3-8}$ cycloalkyl, optionally substituted with halogen, hydroxy, $C_{1-6}$ alkyl, $C_{1-6}$ haloalkyl, $C_{1-6}$ hydroxyalkyl, $C_{2-6}$ alkenyl, $C_{1-6}$ alkoxy or $C_{2-6}$ alkenoxy; $C_{4-8}$ cycloalkenyl, optionally substituted with halogen, hydroxy, $C_{1-6}$ alkyl, $C_{1-6}$ haloalkyl, $C_{1-6}$ hydroxyalkyl, $C_{2-6}$ alkenyl, $C_{1-6}$ alkoxy or $C_{2-6}$ alkenoxy; and $C_{6-14}$ aryl, optionally substituted with halogen, hydroxy, $C_{1-6}$ alkyl, $C_{1-6}$ haloalkyl, $C_{1-6}$ hydroxyalkyl, $C_{2-6}$ alkenyl, $C_{1-6}$ alkoxy or $C_{2-6}$ alkenoxy;

m and n are independently from each other 0, 1, 2, 3, or 4, under the proviso that m+n≠0, when G is a single bond;

each $L_2$ is independently selected from the group consisting of $NR^7R^8$ and $OR^9$, wherein $R^7$, $R^8$ are independently from each other selected from the group consisting of H, $C_{1-6}$ alkyl, optionally substituted with halogen, hydroxy, $C_{2-6}$ alkenyl, $C_{1-6}$ alkoxy or $C_{2-6}$ alkenoxy; phenyl, optionally substituted with halogen, hydroxy, $C_{1-6}$ alkyl, $C_{1-6}$ haloalkyl, $C_{1-6}$ hydroxyalkyl, $C_{2-6}$ alkenyl, $C_{1-6}$ alkoxy or $C_{2-6}$ alkenoxy; and benzyl, optionally substituted with halogen, hydroxy. $C_{1-6}$ alkyl, $C_{1-6}$ haloalkyl, $C_{1-6}$ hydroxyalkyl, $C_{2-6}$ alkenyl, $C_{1-6}$ alkoxy or $C_{2-6}$ alkenoxy;

or $R^7$, $R^8$ form, together with the nitrogen atom they are bonded to, a 3-8-membered ring;

$R^9$ is selected from the group consisting of H; $C_{1-6}$ alkyl; phenyl, optionally substituted with halogen, hydroxy, $C_{1-6}$ alkyl, $C_{1-6}$ haloalkyl, $C_{1-6}$ hydroxyalkyl, $C_{2-6}$ alkenyl, $C_{1-6}$ alkoxy or $C_{2-6}$ alkenoxy; and benzyl, optionally substituted with halogen, hydroxy, $C_{1-6}$ alkyl, $C_{1-6}$ haloalkyl, $C_{1-6}$ hydroxyalkyl, $C_{2-6}$ alkenyl, $C_{1-6}$ alkoxy or $C_{2-6}$ alkenoxy; and (D3) an adduct of formula (VIIc)

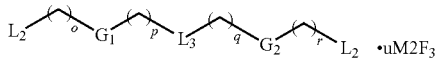

(VIIc)

wherein each M2 is independently B or Al, preferably B;

each $L_2$ is independently as defined in formula (VIIb);

u is a number in the range of 0.8 to 3.0, preferably 1.5 to 3.0, particularly preferably 2.0 to 2.5;

$G_1$, $G_2$ are independently from each other a single bond or a linking group selected from the group consisting of $C_{1-6}$ alkyl, optionally substituted with halogen, hydroxy, $C_{2-6}$ alkenyl, $C_{1-6}$ alkoxy or $C_{2-6}$ alkenoxy; $C_{2-6}$ alkenyl, optionally substituted with halogen, hydroxy, $C_{1-6}$ alkyl, $C_{1-6}$ haloalkyl, $C_{1-6}$ hydroxyalkyl, $C_{1-6}$ alkoxy or $C_{2-6}$ alkenoxy; $C_{3-8}$ cycloalkyl, optionally substituted with halogen, hydroxy, $C_{1-6}$ alkyl, $C_{1-6}$ haloalkyl, $C_{1-6}$ hydroxyalkyl, $C_{2-6}$ alkenyl, $C_{1-6}$ alkoxy or $C_{2-6}$ alkenoxy; $C_{4-8}$ cycloalkenyl, optionally substituted with halogen, hydroxy, $C_{1-6}$ alkyl, $C_{1-6}$ haloalkyl, $C_{1-6}$ hydroxyalkyl, $C_{2-6}$ alkenyl, $C_{1-6}$ alkoxy or $C_{2-6}$ alkenoxy; and $C_{6-14}$ aryl, optionally substituted with halogen, hydroxy, $C_{1-6}$ alkyl, $C_{1-6}$ haloalkyl, $C_{1-6}$ hydroxyalkyl, $C_{2-6}$ alkenyl, $C_{1-6}$ alkoxy or $C_{2-6}$ alkenoxy;

$L_3$ is $NR^{10}$ or O, each $R^{10}$ is independently selected from the group consisting of H; $C_{1-6}$ alkyl; phenyl, optionally substituted with halogen, hydroxy, $C_{1-6}$ alkyl, $C_{1-6}$ haloalkyl, $C_{1-6}$ hydroxyalkyl, $C_{2-6}$ alkenyl, $C_{1-6}$ alkoxy or $C_{2-6}$ alkenoxy; and benzyl, optionally substituted with halogen, hydroxy, $C_{1-6}$ alkyl, $C_{1-6}$ haloalkyl, $C_{1-6}$ hydroxyalkyl, $C_{2-6}$ alkenyl, $C_{1-6}$ alkoxy or $C_{2-6}$ alkenoxy;

o, p, q and rune independently from each other 0, 1, 2, 3 or 4 with the proviso that o+p≠0, when $G_1$ is a single bond, and q+r≠0, when $G_2$ is a single bond.

It is clear to the person skilled in the art that the definitions of s, t and u in the above-defined general formulae (VIIa), (VIIb) and (VIIc) are each mean values over all molecules of the particular fluorination agent.

Preferably the adduct (D1) of formula (VIIa) is an adduct of the Lewis-acid BF3; L1 is preferably selected from $H_2O$; tetrahydrofurane (THF); tetrahydropyrane (THP); $R^2$—O—$R^3$, wherein $R^2$ and $R^3$ independently are selected from the group consisting of methyl, ethyl, n-propyl, iso-propyl and benzyl; H—O—$R^3$, wherein $R^3$ is selected from the group consisting of methyl, ethyl, n-propyl, isopropyl, phenyl and benzyl; ammonia; pyrrolidine; piperidine; $NHR^5R^6$, wherein $R^5$ and $R^6$ independently are selected from the group consisting of methyl, ethyl, n-propyl, iso-propyl, phenyl and benzyl; $NH_2R^6$, wherein $R^6$ is selected from the group consisting of methyl, ethyl, n-propyl, isopropyl, phenyl and benzyl, more preference is given to $H_2O$; THF; THP; diethyl ether; ammonia, ethylamine, isopropylamine and benzylamine. In a particular preferred embodiment of the invention L1 is ethylamine, isopropylamine and benzylamine.

The mean number of $M2F_3$ molecules in Lewis-acid-Lewis-base adducts (D1) of formula (VIIa) is in the range of 0.5 to 1.0, preferably 0.75 to 1.0, particularly preferably 0.8 to 1.0, very particularly preferred 0.9 to 1.0, i. e. the fluorination agent of formula (VIIa) can comprise a mixture of the free Lewis base and Lewis-acid-Lewis-base adducts comprising one molecule $M2F_3$.

Preferably the adduct of the formula (VIIb) is an adduct of the Lewis-acid BF3 and a Lewis-base selected from the group consisting of ethylene diamine, 1,2-cyclohexendiamine, diaminocyclohexane, o-phenylendiamine, p-phenylendiamine, m-phenylendiamine and isophorone diamine (IPDA).

The mean number of $M2F_3$ molecules in Lewis-acid-Lewis-base adducts (D2) of formula (VIIb) is in the range of 0.8 to 2, preferably 1.0 to 2.0, particularly preferably 1.5 to 2.0, i. e. the fluorination agent of formula (VIIb) can comprise a mixture of the free Lewis base, Lewis-acid-Lewis-base adducts comprising one molecule M2F3 and Lewis-acid-Lewis-base adducts comprising two molecules $M2F_3$.

Preferably the adduct of the formula (VIIc) is an adduct of $BF_3$ and diethylenetriamine.

The mean number of $M2F_3$ molecules in Lewis-acid-Lewis-base adducts (D3) of formula (VIIc) is in the range of 0.8 to 3.0, preferably 1.5 to 3.0, particularly preferably 2.0 to 2.5, i.e. the fluorination agent of formula (VIIc) can comprise a mixture of the free Lewis base, Lewis-acid-Lewis-base adducts comprising one molecule $M2F_3$, Lewis-acid-Lewis-base adducts comprising two molecules $M2F_3$ and Lewis-acid-Lewis-base adducts comprising three molecules $M2F_3$.

Depending on the preparation process of the adducts of the formulae (VIIa), (VIIb) and (VIIc), especially the molar ratio of the used starting materials, the mean number of $M2F_3$ molecules in the resulting Lewis-acid-Lewis base adducts can be influenced.

Particularly preferably the soluble fluorination agent (F) is selected from the group consisting of CsF, $NH_4F$, $H_2SiF_6$, $(NH_4)_2SiF_6$, $BF_3$-isophorone diamine, BF3-isopropylamine. BF3-ethyl amine and BF3-benzyl amine.

In order to coat the soft-magnetic powder with silicon dioxide ($SiO_2$) the silicon based solution preferably contains a silicon alkoxide, which is added to the silicon based solution in one or more steps. Suitable silicon alkoxides are for example tetramethylorthosilicate (TMOS), tetraethylorthosilicate (TEOS), tetrapropylorthosilicate and tetraisopropylorthosilicate or mixtures thereof. Such silicon alkoxides provide a soluble form of silicon without any water or hydroxy groups. Thus, a controlled hydrolyzed silicon product is achievable. Preferred is TEOS as silicon alkoxide. Also suitable are silanes with two or three O-r groups, wherein r is a rest as given above, and two or one X1 group(s) directly bound to silane, respectively, wherein X1 is a rest such as H, methyl, ethyl. $C_3$ to $C_{18}$ or propylamine, or even more complex examples like (3-glycidyloxypropyl) trithoxysilane as well as mixtures thereof, which may further be mixed with any of the silicon alkoxide mentioned above.

The soft-magnetic powder is preferably mixed with a silicon based solution and the soluble fluorination agent is added after at least partial treatment of the soft-magnetic powder with the silicon based solution. For instance the soluble fluorination agent is added during treatment with the silicon based solution and/or immediately after treatment with the silicon based solution. Here immediately after treatment with the silicon based solution refers to the step directly following the last step of the treatment with the silicon based solution. The last step of the treatment with the silicon based solution typically comprises or consists of distilling and drying the coated soft-magnetic powder thus providing a dry coated soft-magnetic powder. In the step directly after treatment with the silicon based solution a solvent including the fluorination agent can be added to the coated soft-magnetic powder to provide a soft-magnetic powder coated with the silicon based coating including one of the fluorine containing compositions as specified herein.

In principal, the solution could also be based on other metals and contain the corresponding metal alkoxides in order to coat the soft-magnetic powder with a metal oxide. For example the solution could be based on titanium, magnesium (Mg) or aluminum for producing an aluminum oxide ($Al_2O_3$), magnesium oxide (MgO) or titanium oxide ($TiO_2$, TiO, $Ti_2O_3$) coating. Furthermore the solution could be based on a mixture of metals, such as Si, Al, Mg or Ti, and contain the corresponding mixture of metal alkoxides in order to achieve a mixed coating. Preferably the decomposition of the metal alkoxide is carried out by hydrolysis. For the hydrolysis the metal based solution further contains an inert suspending agent, water and potentially a catalyst.

A reaction mixture including the soft-magnetic powder, the metal based solution and optionally the fluorination agent can be prepared stepwise in one or more steps or gradually. Preferably the reaction mixture is prepared stepwise. In this context stepwise refers to adding least one component of the reaction mixture in one or more steps during the hydrolysis, wherein a stepwise addition may also include the addition at a rate over a specified time range. Thus components may be added in one step at once. Alternatively components can be added in irregular intervals in at least two steps. Gradually means that components are added at a fixed rate or in regular intervals, for example every minute or second, during the hydrolysis. Preferably the metal alkoxide and/or the fluorination agent are added stepwise.

In a first process step the soft-magnetic powder can be mixed with the inert suspending agent, such as water and/or an organic solvent. Suitable organic solvents are protic solvents, preferably monovalent or divalent alcohols, such as methanol, ethanol, iso-propanol, glycol, diethylene glycol or triethylene gycol, or aprotic solvents, preferably ketones, such as aceton, diketone, ether, e.g. diethyl ether, Di-n-butyl ether, dimethyl ether of glycol, diethylene glycol or triethylene glycol, or nitrogenous solvents such as pyridine, piperidine, n-methylpyrrolidine or amino ethanol. Preferably the organic solvent is miscible with water. The suspending agent can be the organic solvent or the organic solvent mixed with water. Preferred organic solvents are acetone, isopropanol and ethanol. Particularly preferred is ethanol. The content of the inert suspending agent in the metal based solution can amount up to 70 wt.-%. Preferably the content of the inert suspending agent lies between 10 and 50 wt.-%.

The mixture of the soft-magnetic powder and the suspending agent is chosen such that a miscible solution is obtained. A high solid fraction is favorable in order to increase yield per volume and time. The optimal solid fraction is easily obtainable through routinely carried out experiments, which allow finding the optimal fraction for the reaction mixture. Furthermore, mechanical stirrers or pump/nozzle-devices can be used to increase the solid fraction.

In a second process step the metal alkoxide can be added to the mixture. The metal alkoxide can be added to the reaction mixture as such or dissolved in the organic solvent.

If an organic solvent is used, the organic solvent contains 10 to 90 wt.-%, preferably 50 to 80 wt.-% of the metal alkoxide. The metal alkoxide can be added stepwise or gradually. Preferred is a stepwise addition of the metal alkoxide in more than one step, preferably two steps. For example up to 90%, up to 50% or up to 20% of a total amount of metal alkoxide needed for the hydrolysis is added to the reaction mixture at first and the remaining amount is added at a later stage of the process.

The total amount of metal alkoxide added to the metal based solution depends on the desired thickness of the coating. Depending on the particle size distribution, the profile of the particles (needle like or spherical) and the amount of powder particles added the overall specific surface can easily be determined. Alternatively known methods such as the BET-method can be employed to determine the specific surface area. From the desired thickness of the coating and the density of the metal oxide the required amount of metal oxide can be calculated. The required total amount of metal alkoxide can then be determined through the stoichiometry of the reaction.

After addition of the metal alkoxide the hydrolysis occurs automatically as soon as water is added to the reaction mixture in a third step. Preferably the total amount of water corresponds to at least twice, further preferred to at least five times the amount of the stoichiometric amount needed for the hydrolysis of the metal alkoxide. Generally, the total amount of water is no higher than one hundred times, preferably twenty times the stoichiometric amount needed. In the third step a fraction of the amount of water is added, which corresponds to the fraction of metal alkoxide added to the reaction mixture in the second process step.

In order to further accelerate the hydrolysis a catalyst such as an alkaline or an acidic catalyst can be added to the reaction mixture. The amount of catalyst added can also be adjusted to the fraction of metal alkoxide added to the reaction mixture in the second process step. Suitable acidic catalysts are for example diluted mineral acids such as sulphuric acid, hydrochloric acid, nitric acid, and suitable alkaline catalysts are for example diluted alkaline lye, such as caustic soda. Preferred is the use of diluted aqueous ammonia solution so the catalyst and water are added simultaneously in one step.

The decomposition of the metal alkoxide, preferably the silicon alkoxide, can further be promoted by thermally heating the prepared reaction mixture in a fourth process step. The reaction mixture can be heated to a temperature just below the boiling point or up to reflux of the reaction mixture. In the case of ethanol for example the temperature is kept below 80° C., e.g. around 60° C. The reaction mixture can be kept at elevated temperature in reflux for a few hours, for example 3 hours. Typically the reaction mixture is dispersed by a mechanical stirrer. Furthermore dispersing agents such as anionic or ionic tensides, acrylic resin, pigment disperser or higher alcohols such as hexanol, octanol, nonanol or dodecanol can be added to the reaction mixture.

If the metal alkoxide is added stepwise in more than one step, the remaining fractions of metal alkoxide, water and catalyst can be added in one or more steps while the reaction mixture is kept at elevated temperature. Preferred is a two step addition of the metal alkoxide, where the remaining fractions of metal alkoxide, water and catalyst are added in one step while the reaction mixture is kept at elevated temperature.

After the hydrolysis the reaction mixture is distilled and dried in a fifth and sixth process step. The point when the hydrolysis finishes can be detected by detecting a decrease in water content in the reflux. Is the water content low enough, the mixture can be distilled and dried leaving the soft-magnetic powder coated with $SiO_2$. In this context, the level of water content can easily be determined through routine experiments.

In one embodiment of the process the soluble fluorination agent is added during treatment with the silicon based solution. Hence, the soluble fluorination agent is added before the treatment with the silicon based solution is finished, i.e. before the reaction mixture is distilled and dried.

In a further embodiment 0.05 to 3.00 mol.-% fluorine, preferred 0.10 to 1.00 mol.-% fluorine, particularly preferred 0.1 to 0.5 mol.-% fluorine are added to the silicon based solution via the soluble fluorination agent. Here the mol.-% fluorine is given in respect to iron and specifies mol fluorine per mol iron. The fluorination agent can be added as solid or in solution. Typically the solvent is water, ethanol or the inert suspending agent mentioned before. For example of 100% silicon alkoxide needed to form 1-2 wt.-% $SiO_2$ on the iron powder 25%, 50% or 75% is added together with the fluorination agent. The preferred molar ratio of silicon alkoxide and fluorine content in the soluble fluorination agent is 0.01 to 10, particularly preferred 0.5 to 3, wherein the molar ratio refers to the ratio across the whole coating. The molar ratio may for instance be 1:5.8. With this ratio the coating can be adapted to provide high permeability due to the thickness of the coating and good temperature stability.

Furthermore, the soluble fluorination agent can be added stepwise in one or more steps during treatment with the silicon based solution. Preferably the soluble fluorination agent is added in one step. The point when the soluble fluorination agent is added can be chosen somewhere after the second process step, i.e. after adding the metal alkoxide, and before the fifth process step, i.e. before distilling and drying. Preferably, the soluble fluorination agent is added while the reaction mixture is kept at elevated temperature. Particularly preferred, the soluble fluorination agent is added before the remaining fraction of metal alkoxide is added while the reaction mixture is kept at elevated temperature. Thus, the soluble fluorination agent can be added after at least 20%, preferably at least 50% and particularly preferred at least 90% of the reactants for the hydrolysis, for example the metal alkoxide, have been added.

The process described above is a preferred embodiment. However, the sequence of process steps can vary. The metal alkoxide can for example be added to the reaction mixture including the soft-magnetic powder, the inert suspending agent, water and the catalyst simultaneously or the water and the metal alkoxide can be added simultaneously. However, in such embodiments a stepwise addition of the metal alkoxide in more than one step is preferred, wherein the soluble fluorination agent is added at once as described above.

Alternatively or additionally the soluble fluorination agent is added immediately after the treatment with the silicon based solution. If the soluble fluorination agent is added immediately after the treatment with the silicon based solution, the soft-magnetic powder is treated by the silicon based solution including or excluding the soluble fluorination agent. The coated soft-magnetic powder can be mixed with a solvent, such as ethanol, and the soluble fluorination agent in the process step following the alkoxide coating process.

The soft-magnetic powder coated according to the processes described above and the coated soft-magnetic powder as specified above are particularly suitable for the manufacture of electronic components. Electronic components such as magnetic cores may be obtained by e.g. press molding or injection molding the coated soft-magnetic powder. To manufacture such electronic components, the coated soft-magnetic powder is typically incorporated with one or more types of resin, such as epoxy resin, urethane resin, polyurethane resin, phenolic resin, amino resin, silicon resin, polyamide resin, polyimide resin, acrylic resin, polyester resin, polycarbonate resin, norbornene resin, styrene resin, polyether sulfone resin, silicon resin, polysiloxane resin, fluororesin, polybutadiene resin, vinyl ether resin, polyvinyl chloride resin or vinyl ester resin.

The method of mixing these components is not limited, and the mixing may be effected by a mixer, e.g. ribbon blender, tumbler, Nauta mixer, Henschel mixer or supermixer or kneading machine, e.g. Banbury mixer, kneader, roll, kneader-ruder, paddle mixer, planetary mixer or monoaxial or biaxial extruder.

To produce a molding, the soft-magnetic powder can be mixed with one or more types of resin in order to provide a mold powder or ready to press powder. For a mold powder a mixture of coated soft-magnetic powder and resin can be heated and molten at a melting point of the resin, preferably the thermoplastic resin, and then formed into an electronic component, such as a magnetic core of desired shape. Preferably the mixture is compressed in a mold to give a magnetic or magnetisable molding. The compression produces a molding which has high strength and good temperature stability.

Another method to produce the molding includes ready to press powder, which contains a coated soft-magnetic powder further coated with a resin. Such ready to press powder can be pressed in a mold at pressures up to 1000 MPa, preferably up to 500 MPa with or without heating. After compression the molding is left to cure. A process to coat the soft-magnetic powder with resin comprises for example the steps of dissolution of the resin, e.g. epoxy resin, in a solvent, addition of a soft-magnetic powder to the mixture, removal of the solvent from the mixture to give a dry product, and grinding of the dry product to give a powder. The ready to press powder is used to produce a magnetic or magnetisable molding.

Powder injection molding allows to produce complex metal parts cost effectively and efficiently. Powder injection molding typically includes pressing the soft-magnetic powders together with a polymer as adhesive into the desired shape, the adhesive is then removed and the powder is compacted into a solid metal part in the sintering phase. This works particularly well with carbonyl-iron powder because the spherical iron particles can be packed together very tightly.

The soft-magnetic powder treated according to the processes described above or containing a silicon based coating with fluorine containing compositions as described above may be used in electronic components. Particularly moldings of this type can be used as coil cores or coil formers as employed in electrical engineering. Coils with corresponding coil cores or coil formers are used by way of example as electromagnets, in generators, in transformers, in inductors, in laptop computers, in netbooks, in mobile telephones, in electric motors, in AC inverters, in electronic components in the automobile industry, in toys, and in magnetic-field concentrators. Electronic components are in particular magnetic core components as used in electrical, electromechanical and magnetic devices such as electromagnets, transformers, electric motors, inductors and magnetic assemblies. Further uses of the coated soft-magnetic powder include manufacture of Radio-Frequency Identification (RFID) tags and elements for reflecting or shielding electromagnetic radiation. In the production of RFID tags, which are labels in the size of rice grains for automatic object localization or identification, soft-magnetic powder may be employed in printing the RFID structure. Lastly, electronic components manufactured of soft-magnetic powder may be used for shielding electronic devices. In such applications, alternating magnetic field of the radiation causes the powder particles to continuously rearrange themselves. Due to the resulting friction, the powder particles convert the energy of the electromagnetic waves into heat.

EXAMPLES

Coating of Metal Powder

Example V1

In a round bottom flask with mechanical stirrer 1 kg carbonyl-iron-powder as for instance available from BASF with a purity of 99.5 g of iron content per 100 g and a size d50 between 4.5 and 5 μm is added. The flask is located in an oil bath and equipped with a condenser and flushed with $N_2$ or Ar to obtain an inert atmosphere. While stirring with 100-1000 rpm, 900 mL ethanol containing 1-2% toluene or methylethylketone is added. Subsequently, 0 g of TEOS is added followed by 160 g of 2.5% $NH_3$ solution. Now the temperature is raised to 60° C. while stirring. The temperature is maintained while 32 g TEOS and 16 g 2.5% $NH_3$ solution is added with two automated pumps at a constant flow rate allowing for the addition during one hour. The reaction mixture is stirred for three further hours at 60° C. The mixture is dried by distilling of the solvent at elevated temperatures. Alternatively, the mixture can be filtrated and the filter cake is dried under vacuum at 60° C.

Example V2-3

The two amounts of TEOS from example V1 were both either halved or doubled.

Example V4, V5, 1 to 6

The examples are carried out as mentioned in example V1. After the dry $SiO_2$ coated powder is obtained 100 g is mixed with 20 g of a solvent like ethanol, water or acetone containing the fluorination agent. In the case of V4 and V5 the fluorination agent is not soluble and the mixture is not a solution but a suspension. The mixture is dried at 40° C. under vacuum yielding the coated carbonyl-iron-powder as a gray powder.

Example V6, 7 to 15

The examples are carried out as mentioned in example V1 until the reaction mixture is stirred for three further hours at 60° C. After three hours the fluorination agent is added directly to the reaction mixture. The condenser is taken off and the product is stirred another hour. During that time the inert gas stream is increased to 600 l/h—already taking some solvent off. After one hour the temperature is raised to 70° C. and the product is stirred under the increased inert gas stream until being dry. The coated carbonyl-iron-powder is obtained as a gray powder.

Example 16

In a round bottom flask with mechanical stirrer 1 kg carbonyl-iron-powder as for instance available from BASF with a purity of 99.5 g of iron content per 100 g and a size d50 between 4.5 and 5 μm is added. The flask is located in an oil bath and equipped with a condenser and flushed with N2 or Ar to obtain an inert atmosphere. While stirring (100-1000 rpm) 900 mL ethanol is added. Subsequently, 6 g of TEOS is added followed by 160 g of 2.5% $NH_3$ solution. Now the temperature is raised to 60° C. while stirring. The temperature is maintained while 13 g TEOS and 8 g 2.5% $NH_3$ solution is added with two automated pumps at a constant flow rate allowing for the addition during one hour. Now the fluorination agent is added directly to the reaction mixture. The temperature is maintained while 19 g TEOS and 8 g 2.5% $NH_3$ solution is added with two automated pumps at a constant flow rate allowing for the addition during one hour. The mixture is stirred for one more hour. The condenser is taken off and the product is stirred another hour. During that time the inert gas stream is increased to 600 l/h—already taking some solvent off. After one hour the temperature is raised to 70° C. and the product is stirred under the increased inert gas stream until being dry. The coated carbonyl-iron-powder is obtained as a gray powder.

Example 17, 18

The examples are carried out as mentioned in example V1 but the fluorination agent is added directly to the CIP powder before adding the ethanol.

Example V7, 19

In examples V7 and 19 instead of carbonyl iron powder a Fe—Si—Cr alloy (4% Si, 4% Cr, d50 between 15 and 25 μm) has been used.

Example V7 concerns the uncoated alloy and example 19 the alloy coated with a procedure similar to example 16. This time, however, 75% of reactants for hydrolysis are added and the fluorination agent is added in one step with the remaining 25% of reactants for hydrolysis during hydrolysis.

Mixing with Epoxy Resin 100 g of the coated carbonyl iron powder (CIP) were mixed with epoxy resin, e.g. Epikote™ 1004 available from Momentive, by dissolving 2.8 g epoxy resin in 20 mL of solvent (methylethylketone or acetone) and addition of 0.14 g of dicyandiamide, e.g. Dyhard® 100SH available from Alzchem, as hardener. In a glass beaker the coated CIP is stirred together with the epoxy formulation using a dissolver mixer at 1000 Ft/min. After mixing the slurry is poured in an aluminum plate, which is then put in a fume hood for 8 h. The resulting dry CIP epoxy plate is milled in a knife mill for 10 seconds to yield the ready to press powder.

Molding and Wiring of Ring Core 6.8 g (±0.1 g) of the ready to press powder is put into a steel mold of ring type with an outer diameter of 20.1 mm and an inner diameter of 12.5 mm resulting in a height of approximately 5-6 mm. The ready to press powder is molded at 440 MPa for a couple of seconds. From the exact mass and height of the ring the density of the ring core is calculated. The ring core is wired with 20 windings of an isolated 0.85 mm copper wire, e.g. MuKogan® 2000MH 62 available from Isodraht, for determination of the permeability and resistivity.

Measurement of Permeability and Resistivity

An LRC meter was used to measure permeability of a ring core. All measurements were done at 100 kHz with 0V DC bias. The test AC current of 10 mA was applied to the ring core.

To measure the resistivity of the pressed parts, a power supply was connected in series to a voltmeter and a sample. 300 Volts were applied to a multimeter and the sample connected in series. Voltage reading of a multimeter was used to estimate the resistance of the sample using following equation.

$$R_{sample}=R_{meter}\times(V_{PS}-V_{meter})/V_{meter},$$

where $R_{sample}$ is the resistance of the cylinder, $R_{meter}$ is the internal resistance of the meter, $V_{PS}$ is the applied voltage from power supply (=300 V), and $V_{meter}$ is the reading from the voltmeter.

Temperature Stability

Before the temperature stability test can start the epoxy is cured. This is done by placing the ring cores in oven set to 70° C. After 2 h the ring cores are placed into a second oven set to 155° C. After 2 h the ring cores are taken out for resistivity testing.

Now the ring cores are placed again into an oven set to 155° C. for an amount of time. The temperature stability after 500 h e.g. is measured after additional 496 h of temperature treatment at 155° C. The 4 h of curing (2 h at 70° C. and 2 h at 155° C.) are also considered as temperature treatment. The ring cores are labeled as temperature stable if the internal resistivity is >1 MΩ after 500 h.

Test Results

After temperature treatment of the compacted samples the permeability and the resistivity were determined as described above. The results are given in Tables 1 to 5.

In examples 1 to 6 of Table 2 different soluble fluorination agents are utilized, which were added immediately after hydrolysis in one step, i.e. after the powder was distilled and dried. In examples V4 and V5 of Table 2 different non-soluble fluorination agents are utilized, which were added immediately after hydrolysis in one step. The amount of fluorination agent used in the process is given with respect to the iron content. After preparation the permeability and the resistivity are determined.

Furthermore. Table 1 shows comparative examples V1 to V3, for which CIP is coated with different amounts of $SiO_2$ and no fluorination agent was added. Similar to the examples of Table 2 after the preparation the permeability and the resistivity are determined.

As can be seen from the results in Tables 1 and 2, the permeability in comparative examples V1 and V3 is lower than the permeability of examples 1 and 3. The permeability of examples V4 and V5 lies around the permeability of comparative example V1. However, the resistivity after temperature treatment shows that examples 1 and 3 provide better temperature stability signified by a higher resistivity than the comparative examples V1 to V5. For examples 1 and 3 this is due to the soluble fluorination agent used in preparing such samples. Thus, in contrast to non soluble fluorination agent such as $MgF_2$ and NaF, soluble fluorination agents such as CsF and $BF_3$-Benzylamin provide for better temperature stability and at the same time achieve a high permeability.

Table 3 specifies the permeability and the resistivity for carbonyl-iron powder coated with a $SiO_2$ coating based on a non-soluble fluorination agent (V6) and coated with a silicon based coating including a fluorine containing composition based on soluble fluorination agents (4 to 11). In these examples 100% of reactants for hydrolysis were added and the fluorination agent was added immediately after hydrolysis before the powder is distilled and dried. The results given in Table 3 also illustrate that the coating containing soluble fluorination agents provides for better temperature stability and at the same time achieves a high permeability.

Similar conclusions can be drawn from Table 4 which shows results for adding 50% of reactants for hydrolysis followed by the addition of the fluorination agent in one step with the remaining 50% during hydrolysis. Table 5 illustrates results for adding the fluorination agent together with the reactants of the hydrolysis right at the start of the hydrolysis.

Table 6 concerns examples with alloys. It shows results for the uncoated alloys and for adding 75% of reactants for hydrolysis followed by the addition of the fluorination agent in one step with the remaining 25% during hydrolysis.

TABLE 1 specifies the permeability and the resistivity for carbonyl-iron powder coated solely with $SiO_2$ (V1 to V3).

| No. | $SiO_2$ content [wt.-%] | Resin [wt.-%] | Fluorination agent (F) | F content [wt.-% with respect to Fe content] | F content [mol-% with respect to Fe content] | Permeability (dry) | R [MΩ] 500 h 155° C. |
|---|---|---|---|---|---|---|---|
| V1 | 1 | 2.8 | — | — | — | 17.6 | 0.3 |
| V2 | 0.5 | 2.8 | — | — | — | 22.1 | 0.1 |
| V3 | 1.5 | 2.8 | — | — | — | 15.5 | 0.6 |

TABLE 2 specifies the permeability and the resistivity for carbonyl-iron powder coated with a SiO2 coating based on a non-soluble fluorination agent (V4, V5) and coated with a silicon based coating including a fluorine containing composition based on soluble fluorination agents (1 to 6). Here the fluorination agent is added after hydrolysis in one step.

| No. | $SiO_2$ content [wt.-%] | Resin [wt.-%] | Fluorination agent (F) | F content [wt.-% with respect to Fe content] | F content [mol-% with respect to Fe content] | Permeability (dry) | R [MΩ] 500 h 155° C. |
|---|---|---|---|---|---|---|---|
| V4 | 1 | 2.8 | NaF | 0.12 | 0.16 | 17.5 | 0.3 |
| V5 | 1 | 2.8 | $MgF_2$ | 0.12 | 0.22 | 17.4 | 0.3 |
| 1 | 1 | 2.8 | CsF | 0.44 | 0.16 | 18.6 | 21.5 |
| 2 | 1 | 2.8 | $H_2SiF_6$ | 0.07 | 0.16 | 16.8 | 7.0 |
| 3 | 1 | 2.8 | $BF_3$-benzyl amine | 0.17 | 0.16 | 18 | 14.7 |
| 4 | 1 | 2.8 | $HPF_6$ | 0.07 | 0.16 | 16.5 | 6.9 |
| 5 | 1 | 2.8 | Perfluoro-octyltriethoxysilane | 0.11 | 0.16 | 16.8 | 0.3 |
| 6 | 1 | 2.8 | Perfluorooctane | 0.07 | 0.16 | 17.1 | N.A. |

N.A.: The value was under detection limit

TABLE 3 specifies the permeability and the resistivity for carbonyl-iron powder coated with a SiO2 coating based on a non-soluble fluorination agent (V6) and coated with a silicon based coating including a fluorine containing composition based on soluble fluorination agents (7 to 15). Here 100% of reactants for the hydrolysis are added and the fluorination agent is added in one step immediately after hydrolysis.

| No. | $SiO_2$ content [wt.-%] | Resin [wt.-%] | Fluorination agent (F) | F content [wt.-% with respect to Fe content] | F content [mol-% with respect to Fe content] | Permeability (dry) | R [MΩ] 500 h 155° C. |
|---|---|---|---|---|---|---|---|
| 7 | 1 | 2.8 | $H_2SiF_6$ | 0.07 | 0.16 | 16.9 | 3.0 |
| V6 | 1 | 2.8 | $MgF_2$ | 0.12 | 0.22 | 18 | 0.3 |
| 8 | 1 | 2.8 | $BF_3$-IPDA | 0.30 | 0.16 | 17.7 | 37240.0 |
| 9 | 1 | 2.8 | $BF_3$-isopropylamin | 0.12 | 0.16 | 17.7 | 92.8 |
| 10 | 1 | 2.8 | $BF_3$-ethylamin | 0.11 | 0.16 | 17 | 4956.7 |
| 11 | 1 | 2.8 | $BF_3$—$2H_2O$ | 0.10 | 0.17 | 16.2 | 2282.3 |
| 12 | 1 | 2.8 | $NH_4F$ | 0.11 | 0.16 | 17.2 | 25.1 |
| 13 | 1 | 2.8 | CsF | 0.17 | 0.06 | 18 | 0.8 |
| 14 | 1 | 2.8 | CsF | 0.44 | 0.16 | 18.2 | 1.9 |
| 15 | 1 | 2.8 | $BF_3$-benzyl amine | 0.17 | 0.16 | 16 | 1480 |

TABLE 4 specifies the permeability and the resistivity for carbonyl-iron powder coated with a silicon based coating including a fluorine containing composition based on a soluble fluorination agent (13). Here 50% of reactants for hydrolysis are added and the fluorination agent is added in one step with the remaining 50% during hydrolysis.

| No. | $SiO_2$ content [wt.-%] | Resin [wt.-%] | Fluorination agent (F) | F content [wt.-% with respect to Fe content] | F content [mol-% with respect to Fe content] | Permeability (dry) | R [MΩ] 500 h 155° C. |
|---|---|---|---|---|---|---|---|
| 16 | 1 | 2.8 | $BF_3$-benzyl amine | 0.17 | 0.16 | 16.3 | 29.2 |

TABLE 5 specifies the permeability and the resistivity for carbonyl-iron powder coated with a silicon based coating including a fluorine containing composition based on a soluble fluorination agent (14 and 15). Here the fluorination agent is added at the beginning of the hydrolysis.

| No. | $SiO_2$ content [wt.-%] | Resin [wt.-%] | Fluorination agent (F) | F content [wt.-% with respect to Fe content] | F content [mol-% with respect to Fe content] | Permeability (dry) | R [MΩ] 500 h 155° C. |
|---|---|---|---|---|---|---|---|
| 17 | 1 | 2.8 | CsF | 0.44 | 0.16 | 19.6 | 0.1 |
| 18 | 1 | 2.8 | $BF_3$-benzyl amine | 0.17 | 0.16 | 17.5 | 0.8 |

TABLE 6 specifies the permeability and the resistivity for the bare Fe—Si—Cr alloy powder (4% Si, 4% Cr) and the alloy powder coated with a silicon based coating including a fluorine containing composition based $BF_3$-benzyl amine (13). Here 75% of reactants for hydrolysis are added and the fluorination agent is added in one step with the remaining 25% during hydrolysis.

| No. | $SiO_2$ content [wt.-%] | Resin [wt.-%] | Fluorination agent (F) | Permeability (dry) | R [MΩ] 500 h 155° C. |
|---|---|---|---|---|---|
| V7 | — | 2.8 | — | 25.1 | 0.6 |
| 19 | 1 | 2.8 | $BF_3$-benzyl a mine | 19.8 | $>10^5$* |

*The voltage was under the detection limit due to high resistivity.

The invention claimed is:

1. A soft-magnetic powder coated with a silicon based coating, wherein the silicon based coating comprises at least one of the following fluorine containing compositions:

a) a fluorine containing composition of formula (I)

$$Si_{1-0,25a}M1_aO_{2-0,5b}F_b \quad (I)$$

wherein a is in the range of 0.015 to 0.52, b is in the range of 0.015 to 0.52,

M1 is H, K, Rb, Cs or $NR^1_4$, wherein each $R^1$ is independently selected from the group consisting of H, $C_{1-6}$ alkyl, phenyl and benzyl;

b) a fluorine containing composition of formula (II)

$$Si_{1-0,75c}M2_cO_{2-0,5d}F_d \quad (II)$$

wherein c is in the range of 0.005 to 0.17, d is in the range of 0.015 to 0.52,

M2 is B or Al;

or c) a fluorine containing composition of formula (III)

$$Si_{1-1,25e}P_eO_{2-0,5f}F_f \quad (III)$$

wherein e is in the range of 0.003 to 0.10, and f is in the range of 0.015 to 0.52.

2. The soft-magnetic powder of claim 1, comprising at least one fluorine containing composition of formula (I), wherein M1 is H, Cs or $NH_4$ and at least one fluorine containing composition of formula (II), wherein M2 is B.

3. The soft-magnetic powder of claim 1, wherein silicon based coating comprises between 0.1 to 5 wt.-% of the at least one fluorine containing composition of formula (I), (II) or (III).

4. The soft-magnetic powder of claim 1, wherein the fluorine component of the fluorine containing composition is embedded within a $SiO_2$-matrix and/or bonded to a surface of a $SiO_2$-coating.

5. The soft-magnetic powder of claim 1, wherein the silicon based coating has an average thickness of 2 to 100 nm.

6. A process for coating the soft-magnetic powder, the coating comprising at least one of the following fluorine containing compositions:

a) a fluorine containing composition of formula (I)

$$Si_{1-0,25a}M1_aO_{2-0,5b}F_b \quad (I)$$

wherein a is in the range of 0.015 to 0.52, b is in the range of 0.015 to 0.52,

M1 is 1H, K, Rb, Cs or $NR^1_4$, wherein each $R^1$ is independently selected from the group consisting of H, $C_{1-6}$ alkyl, phenyl and benzyl;

b) a fluorine containing composition of formula (II)

$$Si_{1-0,75c}M2_cO_{2-0,5d}F_d \quad (II)$$

wherein c is in the range of 0.005 to 0.17, d is in the range of 0.015 to 0.52,

M2 is B or Al;

or c) a fluorine containing composition of formula (III)

$$Si_{1-1,25e}P_eO_{2-0,5f}F_f \quad (III)$$

wherein e is in the range of 0.003 to 0.10, and f is in the range of 0.015 to 0.52 wherein the soft-magnetic powder is mixed with a silicon based solution containing a soluble fluorination agent (F).

7. The process of claim 6, wherein the soft-magnetic powder is mixed with a silicon based solution and soluble fluorination agent (F) is added after at least partial treatment of the soft-magnetic powder with the silicon based solution.

8. The process of claim 6, wherein the at least one soluble fluorination agent (F) is (A) a salt of formula (IVa) or (IVb)

$$M1F \quad (IVa)$$

$$M2F_3 \quad (IVb)$$

wherein

M1 is defined as in formula (I),

M2 is defined as in formula (II);

(B) a compound of formula (V)

$$(M3)_2(SiF_6) \quad (V)$$

wherein

M3 is H, Na, K, Rb, Cs or $NR^1_4$, wherein $R^1$ is defined as in formula (I);

(C) a compound of formula (VI)

$$M3PF_6 \quad (VI);$$

wherein

M3 is defined as in formula (V);

or (D) a Lewis acid-Lewis base adduct, wherein the Lewis acid is $M2F_3$ with

M2 is defined as in formula (II).

9. The process of claim 8, wherein the at least one Lewis acid-Lewis base adduct is selected from the group consisting of (D1) an adduct of formula (VIIa)

$$L_1 \bullet sM2F_3 \quad (VIIa)$$

wherein

M2 is defined as in formula (II);

$L_1$ is $R^2$—O—$R^3$ or $NR^4R^5R^6$;

s is a number in the range of 0.5 to 1.0;

$R^2$, $R^3$ are independently from each other selected from the group consisting of H; $C_{1-6}$ alkyl, optionally substituted with halogen or hydroxy; $C_{3-8}$ cycloalkyl, optionally substituted with halogen, hydroxy, $C_{1-6}$ alkyl, $C_{1-6}$ haloalkyl, $C_{1-6}$ hydroxyalkyl, $C_{2-6}$ alkenyl, $C_{1-6}$ alkoxy or $C_{2-6}$ alkenoxy; phenyl, optionally substituted with halogen, $C_{1-6}$ alkyl, $C_{1-6}$ haloalkyl, $C_{1-6}$ hydroxyalkyl, $C_{2-6}$ alkenyl, $C_{1-6}$ alkoxy or $C_{2-6}$ alkenoxy; and benzyl, optionally substituted with halogen, $C_{1-6}$ alkyl, $C_{1-6}$ haloalkyl, $C_{1-6}$ hydroxyalkyl, $C_{2-6}$ alkenyl, $C_{1-6}$ alkoxy or $C_{2-6}$ alkenoxy;

or $R^2$, $R^3$ form, together with the oxygen atom they are bonded to, a 3-8-membered ring;

$R^4$, $R^5$, $R^6$ are independently from each other selected from the group consisting of H; $C_{1-6}$ alkyl, optionally substituted with halogen or hydroxyl; phenyl, optionally substituted with halogen, $C_{1-6}$ alkyl, $C_{1-6}$ haloalkyl, $C_{1-6}$ hydroxyalkyl, $C_{2-6}$ alkenyl, $C_{1-6}$ alkoxy or $C_{2-6}$ alkenoxy; and benzyl, optionally substituted with halogen, $C_{1-6}$ alkyl, $C_{1-6}$ haloalkyl, $C_{1-6}$ hydroxyalkyl, $C_{2-6}$ alkenyl, $C_{1-6}$ alkoxy or $C_{2-6}$ alkenoxy;

or two of $R^4$, $R^5$, $R^6$ form, together with the nitrogen atom they are bonded to, a 3-8-membered ring;

(D2) an adduct of formula (VIIb)

(VIIb)

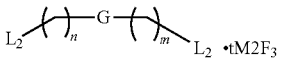

wherein each M2 is independently as defined in formula (II);

t is a number in the range of 0.8 to 2;

G is a single bond or a linking group selected from the group consisting of $C_{1-6}$ alkyl, optionally substituted with halogen, hydroxy, $C_{1-6}$ alkoxy or $C_{2-6}$ alkenoxy; $C_{2-6}$ alkenyl, optionally substituted with halogen, hydroxy, $C_{2-6}$ alkenyl, $C_{1-6}$ alkoxy or $C_{2-6}$ alkenoxy; $C_{3-8}$ cycloalkyl, optionally substituted with halogen, hydroxy, $C_{1-6}$ alkyl, $C_{1-6}$ haloalkyl, $C_{1-6}$ hydroxyalkyl, $C_{2-6}$ alkenyl, $C_{1-6}$ alkoxy or $C_{2-6}$ alkenoxy; $C_{4-8}$ cycloalkenyl, optionally substituted with halogen, hydroxy, $C_{1-6}$ alkyl, $C_{1-6}$ haloalkyl, $C_{1-6}$ hydroxyalkyl, $C_{2-6}$ alkenyl, $C_{1-6}$ alkoxy or $C_{2-6}$ alkenoxy; and $C_{6-14}$ aryl, optionally substituted with halogen, hydroxy, $C_{1-6}$ alkyl, $C_{1-6}$ haloalkyl, $C_{1-6}$ hydroxyalkyl, $C_{2-6}$ alkenyl, $C_{1-6}$ alkoxy or $C_{2-6}$ alkenoxy; m and n are independently from each other 0, 1, 2, 3, or 4, under the proviso that $m+n \neq 0$, when G is a single bond;

each $L_2$ is independently selected from the group consisting of $NR^7R^8$ and $OR^9$, wherein $R^7$, $R^8$ are independently from each other selected from the group consisting of H, $C_{1-6}$ alkyl, optionally substituted with halogen, hydroxy, $C_{2-6}$ alkenyl, $C_{1-6}$ alkoxy or $C_{2-6}$ alkenoxy; phenyl, optionally substituted with halogen, hydroxy, $C_{1-6}$ alkyl, $C_{1-6}$ haloalkyl, $C_{1-6}$ hydroxyalkyl, $C_{2-6}$ alkenyl, $C_{1-6}$ alkoxy or $C_{2-6}$ alkenoxy; and benzyl, optionally substituted with halogen, hydroxy, $C_{1-6}$ alkyl, $C_{1-6}$ haloalkyl, $C_{4-6}$ hydroxyalkyl, $C_{2-6}$ alkenyl, $C_{1-6}$ alkoxy or $C_{2-6}$ alkenoxy;

or $R^7$, $R^8$ form, together with the nitrogen atom they are bonded to, a 3-8-membered ring;

$R^9$ is selected from the group consisting of H; $C_{1-6}$ alkyl; phenyl, optionally substituted with halogen, hydroxy, $C_{1-6}$ alkyl, $C_{1-6}$ haloalkyl, $C_{1-6}$ hydroxyalkyl, $C_{2-6}$ alkenyl, $C_{1-6}$ alkoxy or $C_{2-6}$ alkenoxy; and benzyl, optionally substituted with halogen, hydroxy, $C_{1-6}$ alkyl, $C_{1-6}$ haloalkyl, $C_{1-6}$ hydroxyalkyl, $C_{2-6}$ alkenyl, $C_{1-6}$ alkoxy or $C_{2-6}$ alkenoxy;

and (D3) an adduct of formula (VIIc)

(VIIc)

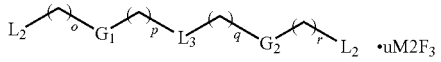

wherein each M2 is independently as defined in formula (II);

each $L_2$ is independently as defined in formula (VIIb);

u is a number in the range of 0.8 to 3.0;

$G_1$, $G_2$ are independently from each other a single bond or a linking group selected from the group consisting of $C_{1-6}$ alkyl, optionally substituted with halogen, hydroxy, $C_{2-6}$ alkenyl, $C_{1-6}$ alkoxy or $C_{1-6}$ alkenoxy; $C_{2-6}$ alkenyl, optionally substituted with halogen, hydroxy, $C_{1-6}$ alkyl, $C_{1-6}$ haloalkyl, $C_{1-6}$ hydroxyalkyl, $C_{1-6}$ alkoxy or $C_{2-6}$ alkenoxy; $C_{3-8}$ cycloalkyl, optionally substituted with halogen, hydroxy, $C_{1-6}$ alkyl, $C_{1-6}$ haloalkyl, $C_{1-6}$ hydroxyalkyl, $C_{2-6}$ alkenyl, $C_{1-6}$ alkoxy or $C_{2-6}$ alkenoxy; $C_{4-8}$ cycloalkenyl, optionally substituted with halogen, hydroxy, $C_{1-6}$ alkyl, $C_{1-6}$ haloalkyl, $C_{1-6}$ hydroxyalkyl, $C_{2-6}$ alkenyl, $C_{1-6}$ alkoxy or $C_{2-6}$ alkenoxy; and $C_{6-14}$ aryl, optionally substituted with halogen, hydroxy, $C_{1-6}$ alkyl, $C_{1-6}$ haloalkyl, $C_{1-6}$ hydroxyalkyl, $C_{2-6}$ alkenyl, $C_{1-6}$ alkoxy or $C_{2-6}$ alkenoxy;

$L_3$ is $NR^{10}$ or O, each $R^{10}$ is independently selected from the group consisting of H; $C_{1-6}$ alkyl; phenyl, optionally substituted with halogen, hydroxy, $C_{1-6}$ alkyl, $C_{1-6}$ haloalkyl, $C_{1-6}$ hydroxyalkyl, $C_{2-6}$ alkenyl, $C_{4-6}$ alkoxy or $C_{2-6}$ alkenoxy; and benzyl, optionally substituted with halogen, hydroxy, $C_{1-6}$ alkyl, $C_{1-6}$ haloalkyl, $C_{1-6}$ hydroxyalkyl, $C_{2-6}$ alkenyl, $C_{1-6}$ alkoxy or $C_{2-6}$ alkenoxy; o, p, q and r are independently from each other 0, 1, 2, 3 or 4 with the proviso that $o+p \neq 0$, when $G_1$ is a single bond, and $q+r \neq 0$, when $G_2$ is a single bond.

10. The process of claim 6, wherein the soluble fluorination agent (F) is selected from the group consisting of CsF, $NH_4F$, $N_2SiF_6$, $(NH_4)_2SiF_6$, $BF_3$-isophorone diamine, $BF_3$-isopropylamine, $BF_3$-ethyl amine and $BF_3$-benzyl amine.

11. The process of claim 6, wherein the soluble fluorination agent is added during treatment with the silicon based solution or immediately after the treatment with the silicon based solution.

12. The process of claim 6, wherein 0.05 to 3 mol.-% fluorine are added to the silicon based solution via the soluble fluorination agent.

13. The process of claim 6, wherein the silicon based solution contains a silicon alkoxide, which is added in one or more steps to a reaction mixture.

14. A process for the manufacture of electronic components using the soft-magnetic powder of claim 1.

15. A process for the manufacture of electronic components obtained from the process of claim 6.

16. An electronic component comprising the soft-magnetic powder of claim 1.

* * * * *